US007017469B2

(12) United States Patent
Penn

(10) Patent No.: US 7,017,469 B2
(45) Date of Patent: Mar. 28, 2006

(54) METERING DEVICE

(76) Inventor: Laurence Richard Penn, 14 Main Street, Middleton, Market Harborough, LE16 8YU (GB)

( * ) Notice: Subject to any disclaimer, the term of this patent is extended or adjusted under 35 U.S.C. 154(b) by 0 days.

(21) Appl. No.: 10/733,163

(22) Filed: Dec. 11, 2003

(65) Prior Publication Data

US 2005/0126384 A1 Jun. 16, 2005

(51) Int. Cl.
*F01L 25/08* (2006.01)

(52) U.S. Cl. ..... 91/275; 91/277; 91/350; 91/361

(58) Field of Classification Search ..... 91/275, 91/277, 328, 350, 361; 137/625.65; 222/249, 222/253

See application file for complete search history.

(56) References Cited

U.S. PATENT DOCUMENTS 2,803,110 A * 8/1957 Chittenden ..... 91/275
3,465,686 A * 9/1969 Nugier ..... 91/275
3,847,371 A * 11/1974 Norton et al. ..... 91/275
4,162,750 A * 7/1979 Demers et al. ..... 91/275
4,830,230 A * 5/1989 Powers ..... 91/350
4,889,035 A * 12/1989 Goodnow ..... 91/275
5,325,762 A * 7/1994 Walsh et al. ..... 91/275
5,868,165 A * 2/1999 Tranovich ..... 137/625.23

* cited by examiner

*Primary Examiner*—Thomas E. Lazo
(74) *Attorney, Agent, or Firm*—Egbert Law Offices

(57) ABSTRACT

A metering device of the type in which a shuttle moves axially within a chamber between two terminal positions, with the chamber having fluid inlet and outlet at each end so that fluid may enter through one end to move the shuttle to cause fluid to be ejected through the other end, and vice versa. A control valve is provided to control the fluid flow, the control valve being a spool valve having a spool sealingly slidable within a bore, the spool valve being associated with a device to drive the spool between two alternate positions in response to the shuttle reaching each end of the chamber.

13 Claims, 4 Drawing Sheets

METERING DEVICE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

This invention relates to a metering device and more particularly relates to a metering device of the type incorporating an elongate chamber having a shuttle contained within the chamber, the shuttle having a portion which is a substantially sealing sliding fit within the chamber, the shuttle being movable between an initial position and a second position with the chamber, each end of the chamber defining fluid flow means through which pressurized fluid may enter and leave the chamber, there being a valving arrangement adapted to control the flow of pressurized fluid to and from the chamber such that, during successive cycles of operation of the metering device, fluid is supplied to one end of the chamber causing the shuttle to move from the initial position at the said one end of the chamber to the second position at the other end of the chamber to eject a predetermined metered volume of fluid from the chamber and subsequently fluid is supplied to the said other end of the chamber causing the shuttle to move back from the second position to the initial position again ejecting a predetermined metered volume of fluid from the chamber.

BACKGROUND OF THE INVENTION

Various metering devices of this type have been proposed before and reference may be made to a WO90/10190A and WO/007561 which disclose arrangements of this general type.

The valving arrangements used in the prior proposed metering c have been relatively complex and bulky.

The present invention seeks to provide an improved metering device, of the general type discussed above, in which the valving arrangement is relatively simple and capable of being manufactured as a relatively small unit. Certain embodiments of the invention seek to provide a metering device which incorporates facilities to carry out checks on the operation of the metering device.

BRIEF SUMMARY OF THE INVENTION

According to this invention there is provided metering device, said metering device incorporating an elongate chamber, there being a shuttle contained within the chamber, the shuttle having a portion which is a substantially sealing sliding fit within the chamber, the shuttle being movable axially between an initial position and a second a second position within the chamber, each end of the chamber defining fluid flow means through which fluid may enter and leave the chamber, there being valve means adapted to control the flow of fluid to and from the chamber such that, during successive cycles of operation the metering device, fluid is supplied to one end of the chamber causing the shuttle to move from the initial position at said one end of the chamber to the second position at the other end of the chamber thus ejecting a predetermined volume of fluid from the chamber, and subsequently fluid is supplied to said other end of the chamber causing the shuttle to move back from the second position to the initial position again ejecting a predetermined quantity of fluid from the chamber, the valving means comprising a spool valve having a spool sealingly slidable within a bore, the spool valve being associated with means to drive the spool between two alternate positions in response to the shuttle reaching the initial position or the second position, the spool, in one position creating a fluid flow path for pressurized liquid from a fluid flow inlet duct to the fluid flow means at one end of the chamber, and also creating a fluid flow path from the fluid flow means at the other end of the chamber to a fluid flow outlet duct, and in a second position creating a fluid flow path for pressurized liquid from a fluid flow inlet duct to the fluid flow means at the other end of the chamber, and also creating a fluid flow path from the fluid flow means at said one end of the chamber to said fluid flow outlet duct.

Preferably the spool is moved by a motor arrangement, the motor arrangement being controlled by a control unit in response to a signal generated in response to the shuttle reaching the initial position or the second position.

Conveniently the shuttle is provided with two shuttle rods, each shuttle rod extending beyond the chamber, there being a respective movement limiting member located adjacent each rod, contact being established between a rod and a respective movement limiting member when the shuttle reaches the initial position and the second position to generate said signal, at least one of the movement limiting members being adjustably positioned.

Advantageously each movement limiting member is electrically conductive, the shuttle and shuttle rods are electrically conductive and the element defining the chamber contained in the shuttle is electrically conductive, the arrangement being such that when a shuttle rod contacts a movement limiting element, an electric circuit associated with the control device is completed.

Conveniently in the spool of the spool valve comprises four spaced apart sections, each of which a sealing sliding fit within the bore that contains the spool, the four sections being interconnected by three relatively narrow necks, the fluid flow inlet always being in communication with the space surrounding the central narrow neck when the spool is in or being moved between the two alternate positions and a respective part of the fluid flow outlet duct always being in communication with the spaces surrounding each of the other two necks, there being flow ports at spaced locations along the axis of the bore containing the spool which communicate with the fluid flow means provided in the chamber containing the shuttle, the flow ports being positioned such that in one position of the spool a flow port that is in communication with the flow means at one end of the chamber containing the shuttle is open to permit fluid flow from the region surrounding the central neck and a flow port that is in communication with the fluid flow means at the other end of the chamber containing the shuttle is open to permit fluid flow to the space surrounding one of the outer narrow necks, and in the other position of the spool a fluid flow port that is in communication with the other end of the chamber containing the shuttle is open to permit fluid flow from the region surrounding the central neck, and a fluid flow port that is in communication with the fluid flow means at said one end of the chamber containing the shuttle is open to permit fluid flow to the space surrounding the other of said outer necks.

Preferably the unit is provided with a valve connected to said outlet flow duct, the valve being positionable to direct the flow of fluid from the outlet duct to a selected one of a plurality of discharge ports.

Advantageously one of the discharge ports is a main discharge, and a second of the ports is a leakage test port.

Conveniently a third discharge port is provided which is a sampling port.

Advantageously the valve comprises a cylindrical valve member slidably mounted within a cylindrical bore to execute a predetermined axial movement, the valve member having a central portion of a first diameter which is a substantially sealing sliding fit within the bore, and having two axially extending valve rods of less diameter which pass through respective seals at opposed ends of the bore, the valve member having a central chamber defined therein, there being fluid flow ports communicating with the central chamber and the exterior of the valve member provided, respectively, on each of the valve rods and on the central cylindrical portion, the space surrounding each of the valve rods being in fluid flow communication, regardless of the position of the valve member, within said predetermined movement with the fluid flow outlet duct from said spool valve, the valve member having an outlet formed in the cylindrical portion thereof adapted to be aligned, depending upon the position of the valve, with each one of the discharge ports.

The invention also relates to a method of measuring the leakage of a metering unit as described above, the method comprising the steps of positioning the valve member so that the outlet in the cylindrical portion thereof is aligned with the leakage test port, positioning the spool centrally so that the region surrounding the central neck is not in communication with any flow port and applying high pressure fluid to the fluid flow inlet duct and volumetrically determining if any fluid exits from the leakage port.

Preferably the method comprises the additional step of moving the spool to one of the two alternate positions whilst still supplying fluid to the inlet.

The invention also provides a method of sampling the operation of a unit as described above, the method comprising the steps of moving the valve member so that the outlet in the cylindrical portion thereof is aligned with the sampling outlet, and operating the metering device for a predetermined number of strokes of the shuttle and measuring the quantity of fluid ejected through the sampling port.

In one preferred embodiment of the invention wherein the spool valve has first fluid inlet and a first fluid outlet and a said fluid flow means extending to one end of the chamber all located adjacent one end of the bore, and the spool valve has a second fluid inlet and a second fluid outlet for a fluid that is different from the first fluid and the said fluid flow means extending to the other end of the chamber all located adjacent the other end of the bore, the spool having a central region that is a sliding sealing fit within the bore, with a relatively narrow diameter neck at each end thereof so that the spool may in one position connect the first fluid inlet to the fluid flow path extending to one end of the chamber and connect the second fluid to the fluid flow path extending to the other end of the chamber, and in another position may connect the second fluid inlet to the fluid flow path extending to the said other end of the chamber and connect the first fluid outlet to the fluid flow path extending to the said one end of the chamber.

Conveniently part of the chamber intermediate the ends thereof defines a cavity surrounding part of the shuttle adapted to receive a flow of solvent.

Advantageously part of the bore of the spool valve intermediate the ends thereof defines a cavity surrounding part of the spool adapted to receive a flow of solvent.

Conveniently the volume within the chamber that communicates with the flow means at one end of the chamber when the shuttle is at the other end of the chamber is greater than the volume within the chamber that communicates with the fluid flow means at said other end of the chamber when the shuttle is at said one end of the chamber.

Preferably the shuttle is provided with two shuttle rods of different diameter each extending from a respective end of a central part of the shuttle to the exterior of the chamber.

The invention also relates to a metering arrangement comprising two or more metering devices in a type as described above wherein the control units of the devices are interconnected so that the motor arrangements of the spools of the spool valves of all the units are controlled in response to a signal generated in response to the shuttles of all the units reaching the initial position or the second position.

BRIEF DESCRIPTION OF THE SEVERAL VIEWS OF THE DRAWINGS

In order that the invention may be more readily understood, and so that further features thereof may be appreciated, the invention will now be described, by way of example, with reference to the accompany drawings.

DETAILED DESCRIPTION OF THE INVENTION

Figure 1:
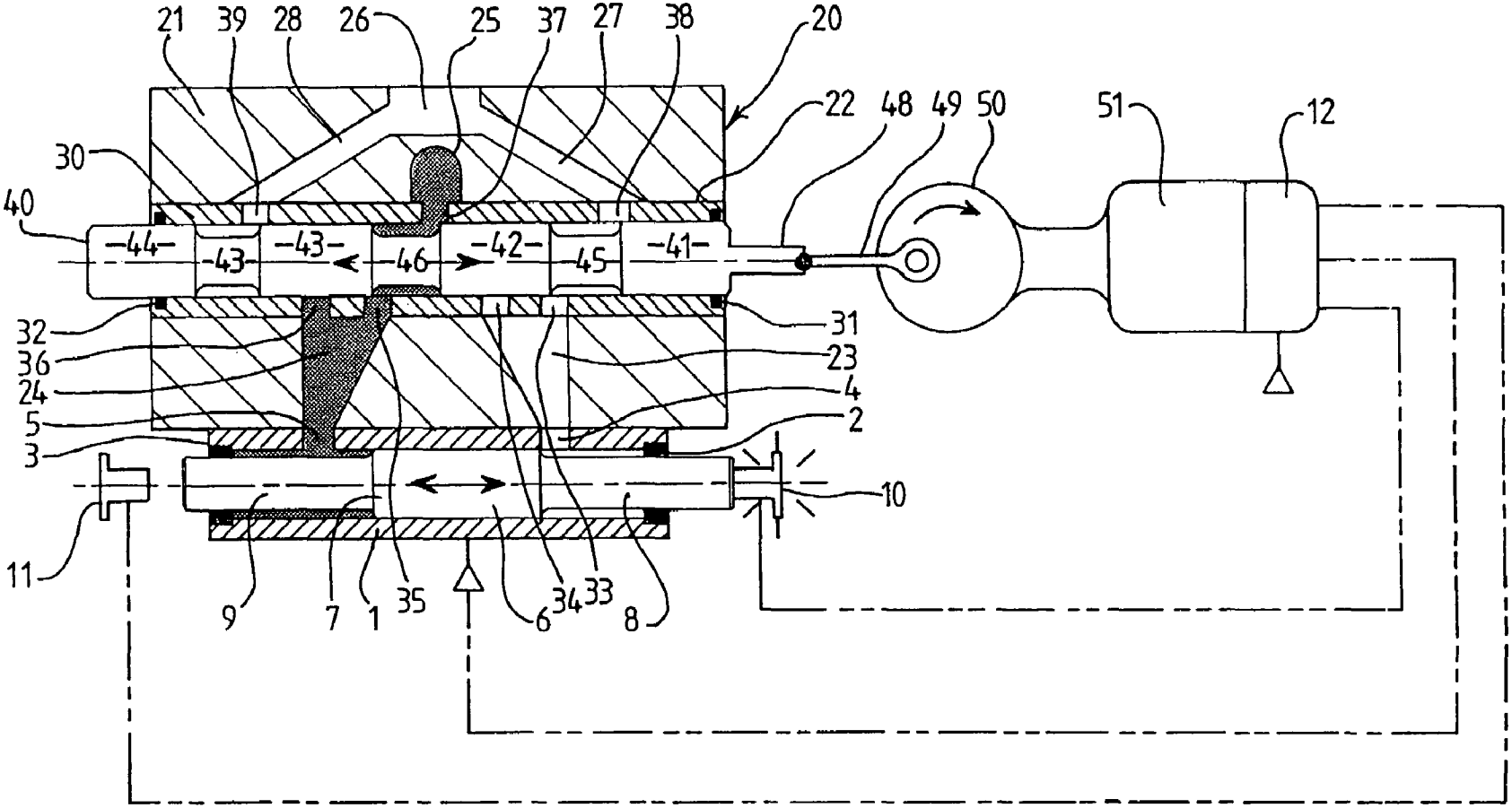
FIG. 1 is a diagrammatic sectional view of a metering de accordance with the invention.

Referring initially to FIG. 1 of the accompanying drawings a metering device in accordance with the invention comprises a cylindrical sleeve 1 which forms a shuttle housing. The sleeve 1 defines a cylindrical bore and at a first end of the bore is a sealing "O-ring" 2 and at the other end of the bore a corresponding sealing "O-ring" 3. Alternative types of seal may be used and if components of the device are made to fine tolerances it may be possible to omit the seals.

In the side wall of the housing, a first fluid flow port 4 and a second fluid flow port 5 are provided which communicate with the bore. The flow ports 4 and 5 are spaced apart and are symmetrically arranged relative to the length of the bore.

Contained within the bore is a shuttle 6. The shuttle 6 is slidable axially along the bore. The shuttle 6 has a central cylindrical region having an outer diameter substantially equal to the inner diameter of the bore such that the central region 7 of the shuttle 6 is a tight but sealingly sliding fit within the bore. Extending axially on a first side of the central region 7 of the shuttle 6 is a cylindrical shuttle rod 8 which has a diameter less than the diameter of the bore. The shuttle rod 8 passes, as a sliding sealing fit, through the sealing "O-ring" 2. Similarly, the other end of the central region 7 of the shuttle 6 is provided with an axially extending cylindrical shuttle rod 9 of the same diameter as the shuttle rod 8, the shuttle rod 9 passing through the sealing "O-ring" 3.

Located adjacent one end of the shuttle rod 8 is an adjustably positioned movement limiting element 10 formed of electrically conductive material to form an electric contact. A corresponding adjustably positioned movement limiting element 11 is provided adjacent the end of the shuttle rod 9. The shuttle is free to move between two alternate positions. In one position the shuttle rod 8 contacts the movement limiting element 10 and in the other position the shuttle rod 9 contacts the movement positioning element 11. By adjusting the position of one or both of the elements 10 and 11 the length of the stroke of the shuttle between the two alternate positions may be adjusted. The fluid flow ports 4 and 5 are spaced apart by such a distance that during the movement of the shuttle the central cylindrical region 7 of the shuttle does not block or mask either of the fluid flow ports 4 and 5.

The sleeve 1 and the shuttle 6 are made of electrically conductive material and the sleeve 1 and the movement limiting elements 10 and 11 are connected to a control unit 12. The control unit 12, as will be described, controls a valving arrangement which, in one condition, supplies fluid under pressure to the flow port 4 and permits the fluid to be dispensed through the flow port 5 and which in an alternate condition supplies fluid to the flow port 5 and permits fluid to be dispensed through the flow port 4. The control unit 12 is adapted so that the condition of the valving arrangement is only altered when the shuttle has completed a stroke and completion of the stroke has been determined by the appropriate shuttle rod making electrical contact with the appropriate movement limiting element and thus completing an electric circuit.

As the position of the movement limiting elements is adjustable the length of the stroke of the shuttle is adjustable and thus the volume of fluid dispensed on each stroke of the shuttle is adjustable.

The metering device, as thus far described, is thus similar to some prior proposed metering devices.

In the described embodiment of the invention a valving unit 20 is provided comprising a monolithic block 21 which is secured to the exterior of the shuttle housing sleeve 1. The block 21 defines a central bore 22 which contains a spool valve unit as will be described hereinafter. The block 21 defines a first fluid flow chamber 23 which communicates with the fluid flow port 4 of the sleeve 1 and which extends to the bore 22 and a corresponding second fluid flow chamber 24, spaced apart from the chamber 23 which similarly extends from the fluid flow port 5 of the sleeve 1 and extends to the bore 22. The monolithic block also defines a fluid flow inlet duct 25 which extends to the bore 22 and additionally defines a bifurcated fluid flow outlet duct 26 having two arms 27, 28 which each extend to the bore 22.

Received within the bore 22 is a spool valve unit which has a cylindrical spool housing 30 defining a cylindrical bore. One end of the cylindrical bore is provided with a sealing "O-ring" 21 and the other end of the cylindrical bore is provided with a corresponding sealing "O-ring" 22. Alternative types of seal may be used if desired.

The cylindrical spool housing is provided with two spaced apart fluid flow ports 33, 34, each of which communicates with the fluid flow chamber 23 which in turn communicates with the fluid flow port 4 of the cylindrical shuttle housing 1. Similarly, in a region spaced from the ports 33, 34, the cylindrical spool housing defines two further fluid flow ports 35, 36 communicating with the fluid flow chamber 24 which communicates with the fluid flow port 5 of the cylindrical shuttle housing 1.

Additionally the spool housing 30 is provided with a further fluid flow port 37 which communicates with the fluid inlet duct 25 and two further spaced apart fluid flow ports 38, 39 respectively each of which communicates with a respective one of the arms 27, 28 of the bifurcated outlet flow passage 26.

Slidably mounted with the bore of the cylindrical spool housing 30 is an elongate spool 40. The spool 40 comprises four cylindrical sections 41, 42, 43 and 44 each having an outer diameter substantially equal to the diameter of the bore, so as to be a sliding sealing fit within the bore, the four cylindrical sections being interconnected by three relatively narrow diameter necks 45, 46 and 47.

One terminal cylindrical section 41 passes as a sliding fit through the sealing "O-ring" 31 and the other terminal cylindrical section 44 passes as a sealing sliding fit through the "O-ring" 32.

The terminal cylindrical section 41 is provided with an extending drive rod 48 which is pivotally connected to a drive link 49 which in turn is pivotally connected to a rotary drive element 50 which is driven by a motor 51, the motor being controlled by the control unit 12. Thus the control unit 12 may actuate the motor to cause the spool 40 to effect a reciprocal movement between two predetermined terminal positions. In an alternative arrangement a solenoid may be provided to act as a linear motor.

The lengths of the cylindrical sections 41, 42, 43 and 44 of the spool 40 and the lengths of the relatively narrow diameter necks 45, 46 and 47 are such that in one position of the spool 40, as shown in FIG. 1, a fluid flow path is created from the fluid flow inlet duct 25 through the flow port 37 provided in the spool housing 30 to a space within the bore surrounding the central neck 46 of the spool 40. The positioning of the spool 40 is such that the fluid flow port 35 formed in the spool housing, which communicates with the fluid flow chamber 24 formed in the unitary block 21, is open permitting fluid flow from the space surrounding the neck 46 of the spool 40. This chamber 24 communicates with the fluid flow port 6 formed in the shuttle housing sleeve 1. Fluid is thus able to flow into the shuttle housing sleeve 1 and, in particular into the portion of the bore within the shuttle housing sleeve 1 that surrounds the shuttle rod 9, thus causing the shuttle rod 9 to move from an initial position (not shown), towards the right to a second or final position as shown in FIG. 1.

As the shuttle 6 moves towards the right so some of the pressurized fluid initially surrounding the shuttle rod 8 within the shuttle housing sleeve 1 is driven through the fluid flow port 5 into the fluid flow chamber 23. The fluid flow port 33 formed in the spool housing 30, which communicates with the fluid flow chamber 23, with the spool 40 in the position indicated, is opened, permitting fluid flow to the space surrounding the neck 45 between the cylindrical sections 41 and 42 of the spool 40. The space surrounding the neck 45 also communicates with the fluid flow port 38 formed in the spool housing which communicates with the arm 27 of the bifurcated outlet flow passage 26. Thus, as the shuttle 6 moves towards the right as shown in FIG. 1, under the influence of the high pressure fluid initially supplied through the inlet duct 25, the shuttle 6 will drive a predetermined volume of fluid through the described flow path to the outlet flow duct 26.

When the shuttle 6 reaches the final position, as shown in FIG. 1, the shuttle rod 8 of the shuttle 6 touches the movement limiting element 10, completing an electric circuit and causing the control unit 12 to actuate the motor 51 to cause the spool 40 to execute a linear movement towards the left. The spool 40 is thus moved to a position in which the space surrounding the neck 45 communicates solely with the flow port 38, with the cylindrical section 42 of the spool 40 blocking the flow port 33. The flow port 34 communicates with the space surrounding the central neck 46, which still communicates with the flow port 37 which, of course, communicates with the inlet duct 25. The cylindrical section 46 of the spool 40 blocks the flow port 35 but is in a position in which the flow port 36 is unblocked and communicates with the space surrounding the neck 47 of the spool 40. The space surrounding the neck 47 communicates with the flow port 39 and thus with one arm 28 of the bifurcated outlet flow passage 26.

With the spool 40 in this position fluid will flow from the inlet duct 25 past the narrow neck 46 and into the flow chamber 23 and thus to the space within the shuttle housing surrounding the shuttle rod 8. The pressure of the fluid will tend to cause the shuttle to move towards the left, as shown in FIG. 1. This will tend to force fluid initially surrounding the shuttle rod 9 into the flow chamber 24 and thus past the relatively narrow neck 47 of the spool 40 into the arm 28 of the outlet flow duct 26. When the shuttle 6 has moved fully towards the left electric contact will be established between the shuttle rod 9 and the movement limiting element 11, completing an electric circuit which actuates the control unit 12 so that the motor 51 returns the shuttle 40 to the original position.

It is to be appreciated, therefore, that in each described cycle of operation, the unit as described above will dispense two "shots" of fluid, each of a predetermined volume. Should the shuttle 6 fail to complete its intended movement, no contact will be established with the movement limiting element 10 or 11 and thus the control unit 12 will not actuate the motor 51 and the described unit will simply stop operating. If appropriate, an alarm unit may be provided to sense any cessation of operation of the described unit.

Whilst the described unit may be utilized to dispense precisely predetermined volumes of pressurized liquid it is envisaged that the unit will find a particular application for use in conjunction with one or more additional corresponding units, with each unit metering a different type of material, the materials then being mixed. In this way it is possible to provide a material comprising a plurality of components, with those components being provided in a precisely predetermined ratio. Thus the material that is eventually supplied may be a two (or more) component adhesive or sealant. If, for example, a very small quantity of one material is to be provided to be mixed with a large quantity of another material, the adjustable movement limiting elements 10 and 11 may be adjusted in one unit as described so that the shuttle 6 may only execute a very small stroke of movement, and in another unit the adjustable elements may be adjusted so that the shuttle of that other unit may execute a very large movement. Of course, it is conceivable to utilize shuttles and shuttle housings of different designs such that the volume surrounding the shuttle rods of each shuttle is very different. In an arrangement of this type a control device may ensure that if one unit ceases operating, the other unit or units cease operating, thus ensuring that no material is dispensed that does not contain the appropriate components in the appropriate ratio.

The unit shown in FIG. 1 can be formed as a small composite with one external inlet pipe and one external outlet pipe.

Referring now to FIGS. 2 to 5 an arrangement is illustrated which incorporates a unit 50 which is very similar to the metering device shown in FIG. 1 except that the upper part of the monolithic block 21 has been replaced by a check valve housing 51. The check valve housing 51 defines a generally cylindrical bore 52 which receives a slidable valve member 53. An inlet flow path 54 is defined which leads to the fluid flow port 37 in the spool housing 30 which leads to the space surrounding the relative narrow neck 46 of the spool 40.

The check valve housing 51 defines a first flow passage 55 which communicates with the bore and the fluid flow port 38 of the spool housing and a further flow passage 56 which communicates with the bore and the flow port 39 of the spool housing. The passages 55 and 56 each have an axial extent greater than that of the associated flow port 38 or 39.

The check valve housing 51 also defines three spaced apart discharge ports 57, 58 and 59 the purpose of which will be described in greater detail below.

The valve member 53 that is mounted within the bore defined by the housing 51 comprises a central cylindrical portion 60 having an outer diameter substantially equal to the inner diameter of the bore defined by the housing 51. A valve rod 61 extends axially from one end of the central cylindrical region 60 and passes through a sealing ring 62 provided at one end of the bore and a corresponding valve rod 63 is provided at the other end of the central cylindrical region 60 which passes through a sealing ring 64 provided at the other end of the bore. Alternative types of seal may be utilized.

The valve member 53 is movable between various positions but in each position the flow chamber 55 communicates with at least part of the space surrounding the valve rod 61 and the flow chamber 56 communicates with at least part of the space surrounding the valve rod 63.

A hollow axially extending central chamber 65 is formed within the valve member 53, the central chamber 65 extending through the central cylindrical region 60 and into each of the valve rods 61, 63. A first flow port 66 formed within the valve member 53, is formed in the valve rod 61 and communicates between the central chamber 65 and the flow chamber 55. A second corresponding flow port 67 formed in the valve rod 63 communicates between the central chamber 65 and the flow chamber 56.

A further flow port 68 in the valve member 53, which is in the central cylindrical portion 63 of the valve member communicates with the central chamber 65. The further flow port 68 can, depending upon the alignment of the valve member 53, communicate with the discharge port 57, the discharge port 58, or the discharge port 59.

When the valve member 53 is in such a position that the flow port 68 associated with the central chamber 65 within the valve member is in alignment with the discharge port 57, a flow path is created from each of the flow discharge ports 38 and 39 of the valve housing 51 to the discharge port 57 which thus acts as an ordinary outlet port and when in this condition the described housing 51 and the associated valve member 53 do not have any effect on the operation of the described metering unit.

However, when it is desired to check whether any of the components of the described metering unit have become worn, causing leakage, then the valve member 53 may be appropriately positioned to determine if any leakage exists.

Figure 2:
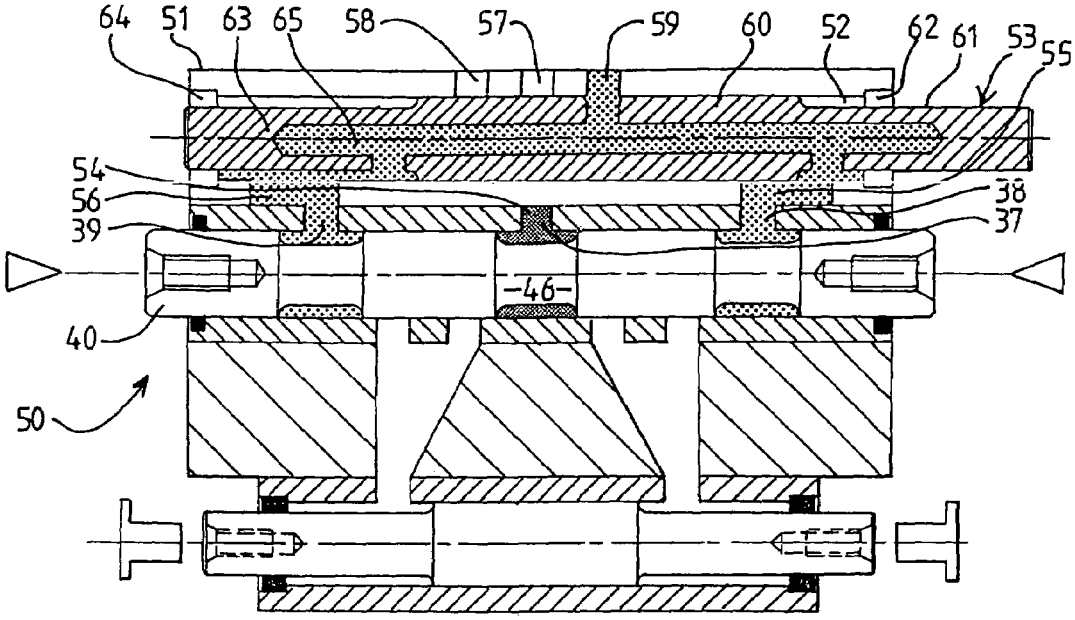
FIG. 2 is a sectional view of an arrangement consisting of a modified embodiment metering device of FIG. 1 with an additional structure to enable the metering device to perform certain tests and checks, showing the arrangement in a first condition.

In performing an initial leakage test, as shown in FIG. 2, the shuttle 6 is centrally positioned, thus being at neither of the terminal ends of its movement and the spool 40 is also centrally positioned. The cylindrical section 42 of the spool 40 thus effectively seals the flow ports 33 and 34 and the cylindrical section 43 effectively seals the flow ports 35 and 36. The valve member 53 is positioned so that the flow duct 58 is in alignment with a discharge port 59 which can be considered to be a "leak" port, since if any fluid flows through this port it will be detecting a leakage. If high pressure fluid is now supplied through the inlet duct 54 to the flow port 48 it is introduced to the space surrounding the relatively narrow neck 46 of the spool. Should this high pressure fluid be able to flow past either of the relatively large diameter cylindrical sections 42 or 43 of the spool 40, the fluid will flow into the region surrounding either the narrow neck 45 or the narrow neck 47 and will thus be able to flow through an open flow path, as shown in FIG. 2, to the leak port 59. If any fluid does appear at the leak port 59, it will indicate that the seal between one or more of the cylindrical sections of the spool 40 and the bore within the spool housing 30 is no longer fluid tight.

Figure 3:
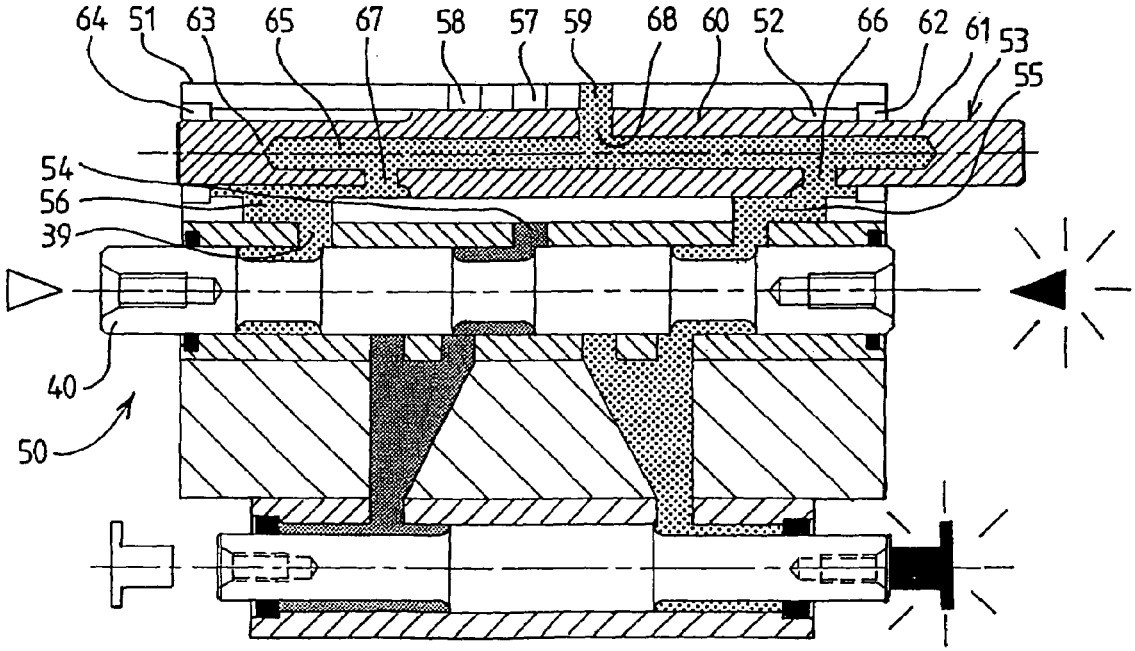
FIG. 3 is another sectional view corresponding to FIG. 2 showing the arrangement of FIG. 2 in a second condition.
Figure 4:
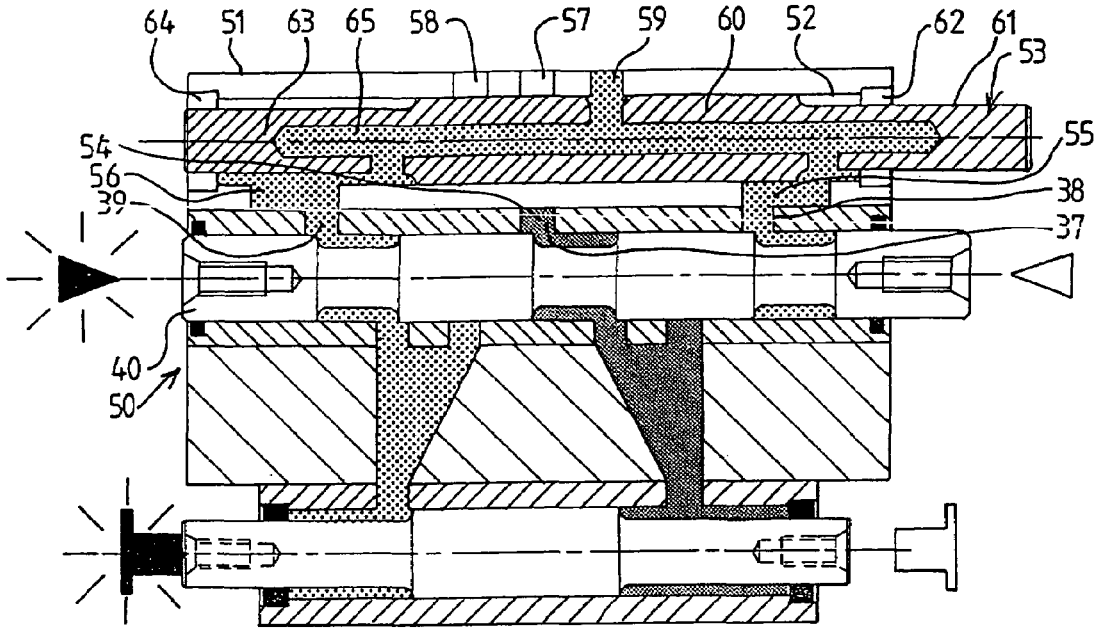
FIG. 4 is a sectional view corresponding to FIG. 2 showing the arrangement of FIG. 2 in a third condition.

With the valve member 53 remaining in the same position, the spool 40 may be moved towards the left to a position as shown in FIG. 3. This will open the flow path from the inlet duct 54 through the chamber 24 to the left hand side of the shuttle 6, thus causing the shuttle to move towards the right, as shown. On the assumption that the described metering device was "empty" before this movement of the shuttle, the movement of the shuttle will not cause any fluid to exit from the leak port 59. However, if there is leakage within the shuttle housing 1 past the cylindrical region 7 of the shuttle 6, fluid will move past the central portion of the shuttle and will flow through the fluid flow chamber 23, past the narrow neck 45 of the spool 40 and thus through the open flow path as shown in FIG. 3 to the leak port 59. In a similar manner, the spool 40 could have been moved from the initial position as shown in FIG. 2 towards the right to a position as shown in FIG. 4 in which case the shuttle would move towards the left, as shown in FIG. 4 and again if there were leakage within the shuttle housing fluid would flow into the flow chamber 24 and thus past the relatively narrow neck 47 of the shuttle and through the open flow path to the leak port 59.

Figure 5:
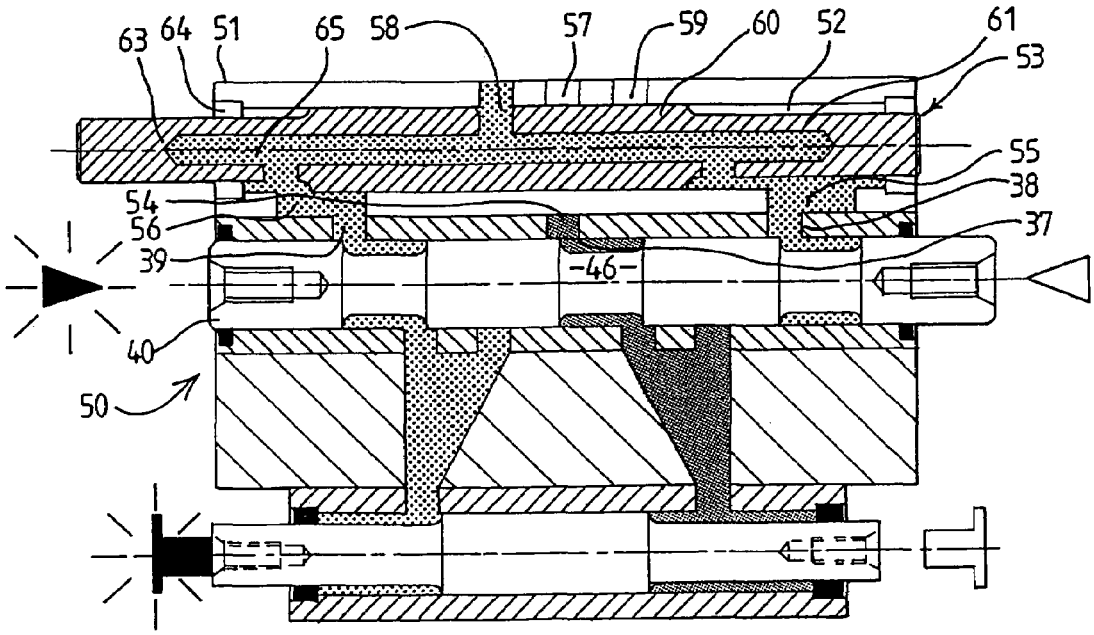
FIG. 5 is another sectional view corresponding to FIG. 2 showing the arrangement of FIG. 2 in a third condition.

The valve member 53 may, as shown in FIG. 5, be moved towards the left so that the flow port 68 is aligned with the discharge port 58 which can be termed a sampling port. The sampling port may be connected to an appropriate device adapted to measure the quantity of fluid ejected. With the valve member 53 in this condition, the metering unit may be operated in the usual way and fluid ejected through the flow ports 38 and 39 will then flow through the sampling port 58. Once a steady-state has been achieved, it is possible to determine the amount of fluid ejected through the sampling port 58 for a predetermined number of cycles of operation of the described device. It is thus possible, with the described unit mounted in position, to sample the accuracy of the metering unit at almost any time.

Embodiments described above each comprise a metering device that is capable of dispensing metered volumes of a single pressurized fluid. The embodiment of FIG. 6, however, is a single metering device that is capable of dispensing metered quantities of two different pressurized fluids.

Figure 6:
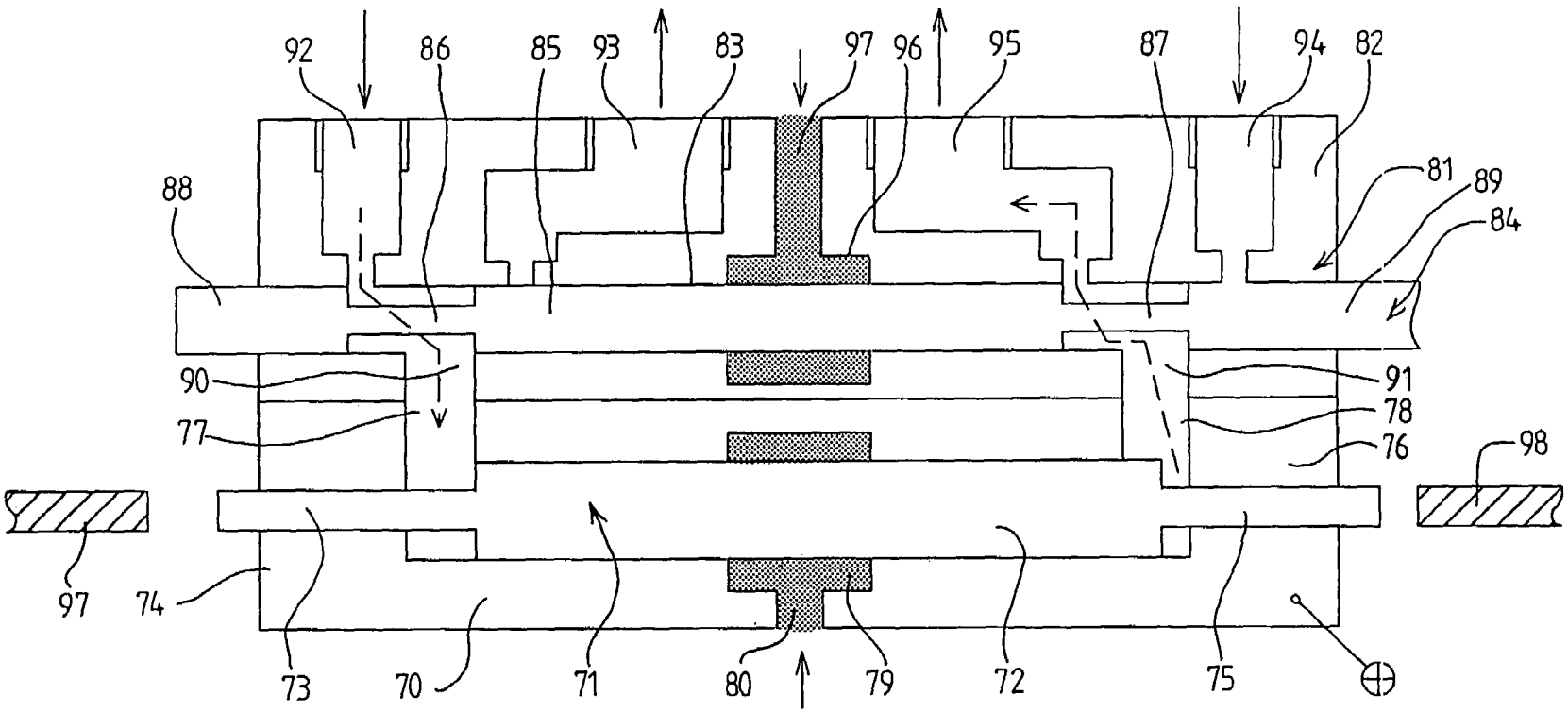
FIG. 6 is a diagrammatic sectional view of another embodiment invention.

FIG. 6 illustrates a metering device which incorporates a lower housing 70 in the form of a generally cylindrical sleeve which defines a cylindrical bore. Contained within the bore is a shuttle 71, the shuttle having a central cylindrical portion 72 which is a sealing sliding fit within the bore. At one end of the shuttle there is an axially extending shuttle rod 73 of a first diameter which passes, in a sliding sealing manner, through an end wall 74 which closes that end of the bore.

At the other end of the shuttle there is an axially extending shuttle rod 75, which is of greater diameter than the shuttle rod 74, the shuttle rod 75 passing in a sliding sealing manner through an end wall 76 which closes that end of the bore.

In the side wall of the housing 70 is a radially extending passage that forms a first fluid flow port 77 which communicates, with the shuttle in a substantially central position, with a space surrounding the shuttle rod 73. At the other end of the housing 71 a similar radially extending fluid flow port 78 is provided which, in a corresponding manner, communicates with a space, when the shuttle is in the central position, around the shuttle rod 75.

The housing 70 defines a substantially centrally located cavity 79 which is located intermediate the ends of the housing, that cavity 79 being connected to a solvent flow duct 80. A cavity totally surrounds the central cylindrical port part 72 of the shuttle. The solvent may be caused to flow through the cavity 79.

The housing 70 is located in position immediately adjacent a valving unit 81. The valving unit 81 comprises a monolithic block 82 which, in the described embodiment, is secured to the exterior of the housing 70 for the shuttle. The monolithic block 82 defines a central bore 83 which contains an axially movable spool 84 which is adapted to be driven by a motor arrangement such as that shown in FIG. 1.

The spool 84 comprises a central section 85 which is mounted as a sliding and sealing fit within a central part of the bore 83. Extending from each end of the central part 85 of the spool is a relatively narrow neck 86, 87. The neck 86 extends to a terminal portion of the spool 88 which is a sliding sealing fit within the bore 83 and the neck 87 extends to a terminal part 89 of the spool which is a further sealing sliding fit within a terminal part of the bore, the terminal part 89 being connected to the drive.

The block 81 defines a flow chamber 90 which communicates between the bore 83 in the region of the neck 86 of the spool valve and the first flow port 77. Similarly the block 81 defines a second flow chamber 91 which communicates between the bore 83, in the region of the neck 87 of the spool, and the second fluid flow port 78.

At the first end of the block 81 an inlet port 92 is provided for a first pressurized liquid, and a first outlet port 93 is provided for the first liquid. The inlet port 92 and the outlet port 93 each communicate with the bore 83 containing the spool valve at such locations that in alternate positions of the spool valve the inlet port 92 and the outlet port 93 communicate with the space within the spool valve which surrounds the neck 86 and thus communicate, via the flow chamber 90, with the first fluid flow port 77.

Similarly, at the other end of the block 81, a second pressurized liquid inlet port 94 is provided and also an outlet port 95 is provided, with those ports again communicating with the bore 83 containing the spool 84 at such locations that in one position of the spool 84 the outlet port 95 communicates, via the fluid flow chamber 91 with the fluid flow port 78 and in a second position of the spool valve the second pressurized liquid inlet port 94 communicates with the fluid flow port 78.

In the central part of the housing 81, intermediate the ends thereof, a chamber 96 is defined which communicates, by means of a flow passage 97 with a source of solvent. The chamber 96 surrounds the central portion 85 of the spool valve which is a sliding sealing fit within the bore 83.

Located adjacent one end of the first shuttle rod 74 is a movement limiting element 79 which may be adjustable or which may be fixed in position. A corresponding movement limiting element 80 is provided adjacent the end of the shuttle rod 75. As in the embodiments described above the movement limiting elements are conductive and a circuit associated with a control unit is completed when a shuttle rod makes contact with a movement limiting element.

It can be seen that with the spool valve in the position illustrated in FIG. 6, if a first pressurized liquid is supplied to the first pressurized inlet port 92, that liquid will flow past the narrow neck 86 of the spool 84 and thus through the fluid flow chamber 90 and the first fluid flow port 77 into a volume within the bore that is traversed by the shuttle rod 73. The shuttle will thus tend to move towards the right. Fluid initially contained within the bore surrounding the shuttle rod 75 will thus be driven upwardly through the second fluid flow passage 78 and the fluid flow chamber 91, past the narrow neck 87 and out of the second liquid outlet port 95.

When the shuttle has moved fully towards the right and contact has been established between the shuttle rod 75 and the movement limiting element 98, a control signal will be generated the motor will be actuated, in a manner corresponding to that described above with reference to the embodiment shown in FIG. 1, to move the spool 84 of the spool valve to an alternate position in which the entire spool valve is moved towards the right as shown in FIG. 6. The spool valve is thus moved to a position in which the inlet port 94 for the second pressurized liquid communicates, via the neck 87, and the fluid flow chamber 91 and the fluid flow port 78 to the space surrounding the shuttle rod provided at the right hand end of the shuttle, as shown, thus causing the shuttle 71 to move towards the left. The first liquid, present in the volume of the bore surrounding the shuttle rod 73 is thus driven upwardly through the first fluid flow duct 77 and the fluid flow chamber 90, past the neck 86 of the shuttle and through the first fluid outlet port 93. When the shuttle 71 has moved fully to the left the control signal that is generated will cause the spool to move to the left so that the process will be repeated.

It is envisaged, therefore, that a single integral unit as described with reference to FIG. 6 may be used to dispense alternate "shots" of two different liquids, such as the components of a two-component adhesive. Since it would be undesirable for the two components of the two-component adhesive to become mixed within the described metering device, the described chambers 79 and 96 for solvent are provided. If solvent is present within the chambers, then any of the liquids to be dispensed which pass along the bore containing the shuttle or along the bore containing the spool will encounter the solvent and will thus not react within the consequent undesired, but predictable, effect that the entire metering unit would become stuck solid.

The solvent may, of course, be circulated through the described cavities 79 and 96.

It is to be appreciated that, in the described embodiment, because the shuttle rod 75 is of greater diameter than the shuttle rod 73 the volume present at the right hand end of the bore containing the shuttle, when the shuttle is in the left hand most position is less than the volume contained within the bore at the left hand end of the shuttle when the shuttle is in the right hand most position. By selecting the diameter of each shuttle rod appropriately, a precise ratio between the dispensed liquids may be achieved.

The description given above has concentrated on the provision of a single unit to dispense either a single liquid or, in the case of the embodiment of FIG. 6, two different liquids. It is to be appreciated that a plurality of units as described above may be set up to operate simultaneously to dispense the components of a multi-component mixture. If it is desired to ensure that only correctly mixed mixture is delivered, the control units of each of the metering devices that will form part of the contemplated assembly may be interconnected, or may be replaced by a single master control unit, with the effect that the motors that drive the spools of the spool valves will all receive a signal to move the respective spool valves in response to all of the shuttles moving, in a desired manner, from a first position to a second position. Thus, it is only when all of the shuttles of all of the units of the assembly have completed a movement to dispense a precisely predetermined volume of liquid that a control signal is given to the spools of the spool valves of all of the units so that the spool valves will move to supply pressurized liquid to move the shuttles in the opposite direction. Should any one of the units of the assembly fail to operate, for whatever reason, the entire assembly will cease operating. Consequently if an error arises, for whatever reason, the entire arrangement ceases operation. This will help ensure that no defective mixture is dispensed.

In each of the described embodiments of the invention, the pressurized fluid that is introduced to the described metering device has a higher pressure than the fluid leaving the metering device. Thus, the shuttle will move as a consequence of the pressure applied to it by the pressurized fluid, and does not need to be driven in any other way. It may be desirable to ensure that the fluid exiting from the metering device has a positive pressure, so that the fluid exhibits through "hydraulic" properties, and this may be achieved in many ways. Nevertheless, it is desirable for the pressure of the fluid supplied to the device to be higher than the pressure of fluid exiting from the device.

In the present specification "comprises" means "includes or consists of" and "comprising" means "including or consisting of".

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilized for realizing the invention in diverse forms thereof.

I claim:

1. A metering apparatus comprising:

an elongate chamber;

a shuttle contained in said chamber, said shuttle having a portion fit with a substantially sealing sliding relationship within said chamber, said shuttle being movable axially between a first position at one end of said chamber and a second position at an opposite end of said chamber, each end of said chamber defining a fluid flow means for allowing fluid to enter and exit said chamber;

a valving means for controlling a flow of fluid to and from said chamber such that fluid is supplied to said one end of said chamber causing said shuttle to move from said first position to said second position so as to eject a predetermined volume of fluid from said chamber and subsequently the fluid is supplied to said opposite end of said chamber so as to cause said shuttle to move back from said second position to said first position so as to eject another predetermined quantity of the fluid from said chamber, said valving means comprising:

a spool valve having a cylindrical spool axially slidingly received within a cylindrical bore;

a driving means cooperative with said spool for driving said spool between two positions in response to said shuttle reaching either said first position or said second position, said spool in one of said two positions creating a fluid flow path for pressurized liquid from a fluid flow inlet duct to said fluid flow means at one end of said chamber and for creating a fluid flow path from said fluid flow means at the other end of said chamber to a fluid flow outlet duct, said spool in the other of said two positions creating a fluid flow path for pressurized liquid from said fluid flow inlet duct to said fluid flow means at said other end of said chamber and creating a fluid flow path from said fluid flow means at said other end of said chamber to said fluid flow outlet duct, said driving means being a motor arrangement that is controlled by a control unit in response to a signal generated in response to said shuttle reaching either said first position or said second position.

2. The apparatus of claim 1, wherein said shuttle has two shuttle rods, each of said two shuttle rods extending beyond said chamber, each of said two shuttle rods having a respective movement limiting member adjacent thereto, the rod and the respective movement limiting member establishing contact when said shuttle reaches said first position and said second position so as to generate said signal, at least one of said movement limiting members being adjustably positioned.

3. The apparatus of claim 2, wherein each movement limiting member is electrically conductive, said shuttle and the shuttle rods are electrically conductive and a chamber contained in the shuttle is electrically conductive, an electric circuit associated with the control unit being completed when the shuttle rod contacts the movement limiting member.

4. The apparatus of claim 1, wherein said spool of said spool valve comprises four spaced apart sections, each of said sections is in a sealing sliding fit within said bore, said four sections being interconnected by three relatively narrow necks, said fluid flow inlet always being in communication with a space surrounding a central narrow neck of said narrow necks when said spool is being moved between the two positions, a respective part of the fluid flow outlet duct always being in communication with the spaces surrounding each of the other two necks, a plurality of flow ports being located at spaced locations along an axis of said bore, the plurality of flow ports being positioned such that in one position of said spool one of said plurality of flow ports that is in communication with the flow means at one end of the chamber containing said shuttle is open to permit flow from the region surrounding the central narrow neck and another of said plurality of flow ports that is in communication with the fluid flow means at the other end of the chamber is open to permit fluid flow to the space surrounding one of the outer narrow necks, and in the other position of said spool the fluid flow port that is in communication with the other end of said chamber is open to permit fluid flow from the region surrounding the central narrow neck, and the fluid flow port that is in communication with the fluid flow means at said one end of the chamber is open to permit fluid flow to the space surrounding the other of said outer narrow necks.

5. The apparatus of claim 1, further comprising:

a valve connected to said outlet flow duct, said valve being positionable to direct the flow of fluid from said outlet flow duct to one of the plurality of discharge ports.

6. The apparatus of claim 5, wherein one of said plurality of discharge ports is a main discharge port and another of said plurality of discharge ports is a leakage test port.

7. The apparatus of claim 6, wherein another of said plurality of discharge ports is a sampling port.

8. The apparatus of claim 5, wherein said valve comprises a cylindrical valve member slidably mounted within a cylindrical bore so as to execute a predetermined axial movement, said valve member having a central portion of a first diameter which is in a substantially sealing sliding fit within said bore, said valve having two axially extending valve rods of lesser diameter which pass through respective seals at opposed ends of said bore, said valve member having a chamber defined therein, said central chamber and the exterior of the valve member having fluid flow ports communicating therewith respectively on each of said valve rods and on the control cylindrical portion, a space surrounding each of said valve rods being in fluid flow communication regardless of the position of said valve member with said fluid flow outlet duct, said valve member having an outlet formed in said cylindrical portion thereof adapted to be aligned with each one of said plurality of discharge ports.

9. The apparatus of claim 1, wherein said spool valve has a first fluid inlet and a first fluid outlet and said fluid flow means extending to one end of said chamber and located adjacent one end of said bore, said spool valve has a second fluid inlet and a second fluid outlet and said fluid flow means extending to the other end of said chamber and located adjacent to the other end of said bore, said spool having a central region that is in a sliding sealing fit within said bore, said spool having a relatively narrow diameter neck at each end thereof so that said spool connects said first fluid inlet to said fluid flow path extending to said one end of said chamber and connects said second fluid inlet to said fluid flow path extending to said other end of said chamber in said one position, and connects said second fluid inlet to said fluid flow path extending to said other end of said chamber and connects said first fluid outlet to said fluid flow path extending to said one end of said chamber in said other position.

10. The apparatus of claim 9, wherein portion of said chamber intermediate the ends thereof defines a cavity surrounding part of said shuttle and adapted to receive a flow of a solvent.

11. The apparatus of claim 9, wherein part of said bore of said spool valve intermediate the ends thereof defines a cavity surrounding part of said spool and adapted to receive a flow of a solvent.

12. The apparatus of claim 9, wherein a volume within said chamber that communicates with said flow means at said one end of said chamber when said shuttle is at said other end of the chamber is greater than a volume within said chamber that communicates with said fluid flow means at said other end of said chamber when said shuttle is at said one end of said chamber.

13. The apparatus of claim 1, wherein said shuttle has two shuttle rods of different diameter, each of said two shuttle rods extending from a respective end of a central part of said shuttle to an exterior of said chamber.

* * * * *